United States Patent [19]

Gewelber

[11] Patent Number: 4,739,934

[45] Date of Patent: Apr. 26, 1988

[54] SPRINKLER HEAD HAVING VARIABLE WATERING PATTERNS

[76] Inventor: Ytzhak Gewelber, 15520 Olive Branch Dr., La Mirada, Calif. 90638

[21] Appl. No.: 884,492

[22] Filed: Jul. 11, 1986

[51] Int. Cl.[4] ..... A62C 31/00

[52] U.S. Cl. ..... 239/446; 239/DIG. 1; 239/444; 239/518; 239/562

[58] Field of Search ..... 239/DIG. 1, 203, 204, 239/205, 444, 446, 447, 518, 562, 574, 582.1

[56] References Cited

U.S. PATENT DOCUMENTS

| | | | |
|---|---|---|---|
| 1,667,964 | 5/1928 | Beddoes | 239/DIG. 1 |
| 1,958,038 | 5/1934 | Fraser | 239/447 |
| 2,634,163 | 4/1953 | Double | 239/562 |
| 2,935,266 | 5/1960 | Coleondro et al. | 239/446 |
| 3,282,508 | 11/1966 | Roberts | 239/204 |
| 3,664,590 | 5/1972 | Knight | 239/DIG. 1 |
| 4,119,275 | 10/1975 | Hunter | 239/562 |
| 4,131,234 | 12/1978 | Pescetto | 239/562 |
| 4,189,099 | 2/1980 | Brunning | 239/574 |
| 4,625,917 | 12/1986 | Torney | 239/444 |

FOREIGN PATENT DOCUMENTS

| | | | |
|---|---|---|---|
| 2815628 | 10/1978 | Fed. Rep. of Germany | 239/542 |

*Primary Examiner*—Kenneth J. Dorner
*Assistant Examiner*—Gerold A. Anderson
*Attorney, Agent, or Firm*—John E. Wagner

[57] ABSTRACT

Applicant's sprinkler head is molded with a large number (such as twelve or sixteen) of potential orifices and directing channels with the orifices all plugged or occluded with comparatively light barriers or plugs of the molded plastic material which are readily punctured and removed by the user. In this way the user may select among many possible watering patterns including not only the above described full, one-half, and one-fourth circles, but may also choose to punch one orifice, giving a thirty or twenty-two and one-half degree arc, then skip one or two plugs, then punch another plug or two. In this manner one or a number of orifices may remain blocked making it possible to, for example, water a thirty degree arc, skip sixty degrees, water another thirty of sixty degree arc, etc. Many such patterns become possible. In one of the embodiments disclosed, the design allows access to the puncturable barriers or plugs from the bottom which means that the user must puncture the desired pattern or orifices before installing the head on the riser pipe. A second embodiment allows access to the puncturable barriers from the head as installed.

5 Claims, 2 Drawing Sheets

SPRINKLER HEAD HAVING VARIABLE WATERING PATTERNS

BACKGROUND OF THE INVENTION

There are many designs of simple and inexpensive sprinkler heads on the market which are all mounted on standard one-half inch sprinkler pipe and which provide sprinkler patterns of predetermined area coverage by covering, for example, full circles, half circles and quarter circles. Other types of sprinkler heads can be adjusted to water in an arc of any desired angle, but such sprinklers are much more complex and expensive then the types under consideration. Many of the sprinkler heads now in use are simple molded plastic elements with a fixed pattern of holes to provide a fixed watering pattern and which normally include a single screwdriver adjusted valve to control the pressure of water flowing out of the head, hence the distance the pattern will reach and the volume of water flowing through the head.

BRIEF SUMMARY OF THE INVENTION

Applicant has designed sprinkler heads comparable in price and complexity to the simple molded types discussed above but which are so configured that the user may make a selection as to a large number of possible watering patterns. The heads are molded with a large number (such as twelve or sixteen) of potential orifices and directing channels with the orifices all plugged or occluded with comparatively light barriers or plugs of the molded plastic material which are readily punctured and removed by the user. In this way the user may select among many possible watering patterns including not only the above described full, half, and quarter circles, but may also choose to punch one orifice, giving a thirty or twenty-two and one-half degree arc, then skip one or two plugs, then punch another plug or two. In this manner one or a number of orifices may remain blocked making it possible to, for example, water a thirty degree arc, skip sixty degrees, water another thirty or sixty degree arc, etc. Many such patterns become possible. In one of the embodiments disclosed, the design allows access to the puncturable barriers or plugs from the bottom which means that the user must puncture the desired pattern of orifices before installing the head on the riser pipe. A second embodiment allows access to the puncturable barriers from the head as installed.

DETAILED DESCRIPTION OF THE PREFERRED EMBODIMENTS

Figure 1:
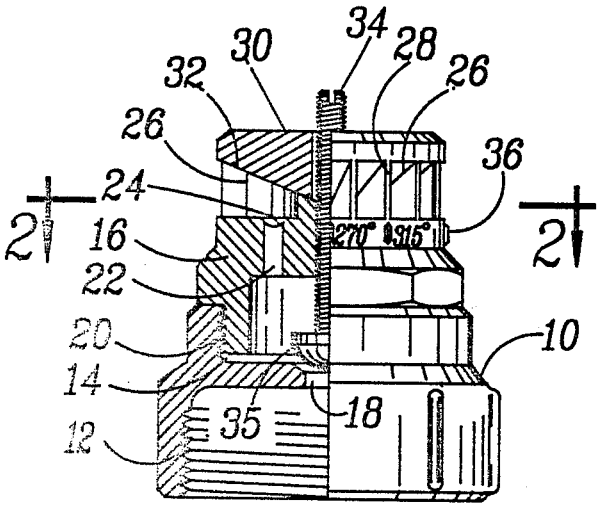
FIG. 1 is a side view, partly in section, of a sprinkler head according to my invention in combination with a standard threaded coupling device for attaching the head to a standard sprinkling system riser pipe.

Referring now to FIG. 1, a standard coupling member 10 is shown which is designed for a standard sprinkler system riser pipe. FIG. 1 is shown partially in section and member 10 includes internal threads 12 for engagement with the riser pipe. It also includes internal threads 14 for engagement with a molded sprinkler head member 16 which is to be secured thereto, and it further includes an orifice 18 which permits the flow from the riser pipe, not shown, through the coupler member 10 to a chamber 20 in the interior of molded member 16. Chamber 20 communicates with a plurality of passageways 22, the number of which may be of the order of 12 or 16, which passageways are plugged or occluded be means of molded plug members 24. Member 16 also includes a plurality of channels 26 which are separated by a plurality of molded webs 28. These webs and channels cooperate with a second molded member or element 30 having a lower tapered surface 32 which surface cooperates with all of the channels formed by orifices 26 and webs 28 to provide a series of water-directing outlet ports. Threadedly engaged with both of molded members 16 and 30 is an adjusting screw 34 which secures member 16 and 30 together and which includes a tapered valve member 35 which cooperates with orifice 18 to control the flow through the sprinkler head.

Figure 2:
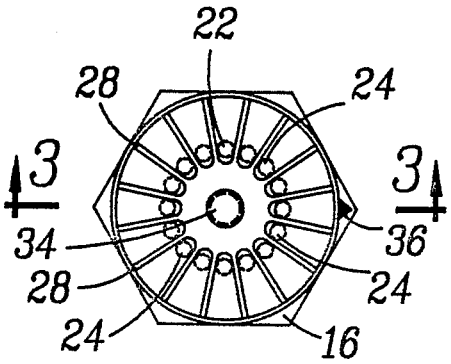
FIG. 2 is a cross-sectional view taken along line 2—2 of FIG. 1.

FIG. 2 is a cross-sectional view taken along line 2—2 of FIG. 1 and shows the many webs 28 which separate the many water-directing channels 26. Each of these channels 26 communicates with one of the passages 22 all of which, in this view, are shown blocked by means of the plugs 24. In this view a cross-section of the adjusting screw 34 is also shown. Positioned on the right side of the sprinkler head, as shown in FIGS. 1 and 2, is an indexing mark 36 to aid the operator in determining the desired direction of sprinkler head flow.

Figure 3:
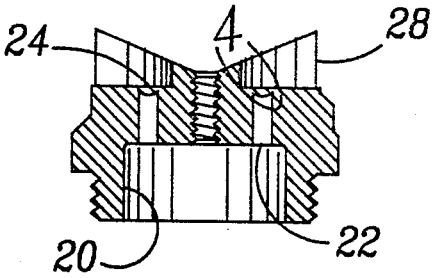
FIG. 3 is a cross-sectional view taken along line 3—3 of FIG. 2.
Figure 4:
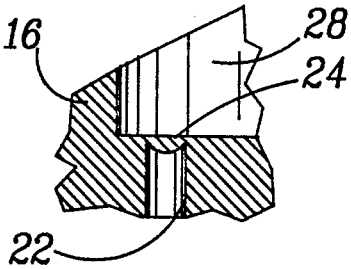
FIG. 4 is an enlarged view of segment 4 of FIG. 3.

FIG. 3 is a sectional view taken along line 3—3 of FIG. 2. This view shows the lower molded part of the two parts consisting of the sprinkler head of FIG. 1. In this view are shown the chamber 20 which provides communication to the many passageways 22 which are plugged by means of plugs 24. Also visible in this view is the contour of the webs 28 which are tapered to match the lower tapered surface 32 of the molded member 30. When these two members are secured together they define the flow-directing orifices from the sprinkler head. FIG. 4 is an enlarged view of a portion of FIG. 3 showing a single passageway 22 and plug 24 in association with a part of a web 28.

Plug 24 is puncturable to be removed by the operator as desired but is capable of withstanding 200 psi of water pressure so that it will not break in the course of normal operation if it is desired that it remain closed. Since there are 16 plugs and 16 passageways and flow-directing orifices leading from a sprinkler head of the type shown in FIGS. 1–4, is will be appreciated that by removal of selective plugs, a user or operator may make any desired selection of 22½ degree arcs around a possible 360 degree circle. This provides the option to skip desired portion of the circle from being watered, to conserve water by watering only certain zones and individual plants as needed, and to increase watering angles as desired when plants develop spread. It will also have the advantage of reducing weed growth due to the ability to place water only where needed.

Figure 5:
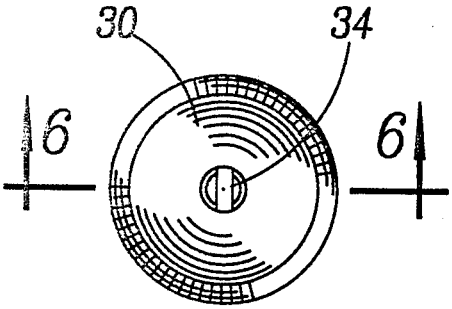
FIG. 5 is a plan view of the top portion of the sprinkler head of FIG. 1.
Figure 6:
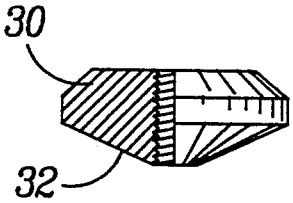
FIG. 6 is a cross-sectional view taken along line 6—6 of FIG. 5.

FIG. 5 is a plan view looking down on the top of the second molded member 30 of FIG. 1. In this view will be seen only the top of member 30 with the adjustment screw 34. FIG. 6 is a cross-sectional view of this same part taken along line 6—6 of FIG. 5. This view shows the tapered surface 32 which cooperates with the webs 28 to define the water-directing outlet ports. The sprinkler head design of FIGS. 1–6 which involves two separate pieces gives rise to the simplest and least expensive tooling and is generally the simplest from the manufacturing standpoint. It will be noted that this design requires that the user using a puncturing tool or possibly a nail, as desired, pre-punch the plugs 24 before the sprinkler head is installed since the plugs are not readily accessible for removal after the head is fastened to the coupling 10.

Figure 7:
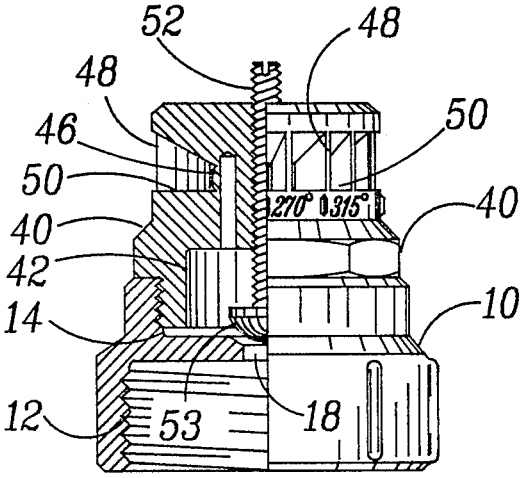
FIG. 7 is a side view, partly in section, of another embodiment of my invention.

FIG. 7 is a side view, partly shown in section, of a second embodiment of my invention wherein the sprinkler head is formed of a single molded piece. In this view member 10 is exactly as described before having internal threads 12 for attachment to a riser pipe, additional internal threads 14 for attachment to sprinkler head 40 and including an orifice 18 for permitting water from the riser pipe to flow into an internal chamber 42 of sprinkler head 40. This sprinkler head also includes a large number of axial passageways 44 which in this case are blocked by means of plugs 46 formed into the sides of the passageways 44. A plurality ot webs 48 separate flows from the various passageways 44 into water-directing outlet ports 50. An adjusting screw 52 threadedly engaged with molded member 40 includes a tapered valve member 53 which cooperates with orifice 18 to limit the volume of flow entering the sprinkler head.

Figure 8:
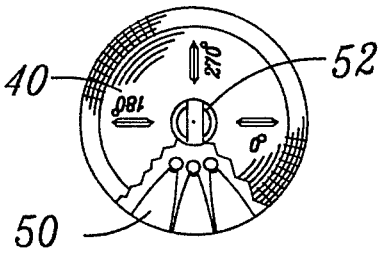
FIG. 8 is a plan view, partly broken away, of the top of the sprinkler head of FIG. 7.
Figure 9:
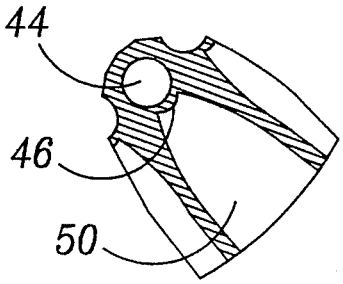
FIG. 9 is an enlarged view partly in section, of segment 9 of FIG. 8.

FIG. 8 is a plan view of the top portion of FIG. 7 but which is shown partially broken away. In this view is shown sprinkler head 40 and adjusting screw 52 along with 0 degree, 180 degree and 270 degree indexing marks which are useful for assisting the user in directing the flow from the sprinkler head. In the broken away portion are shown a number of the outlet ports 50. An enlarged view, shown partly in section, of this broken-away portion of FIG. 8, is shown in FIG. 9. In this view the top of one of the axial flow passages is shown blocked by means of a plug 46, the removal of which would permit water to flow through the outlet port 50.

Figure 10:
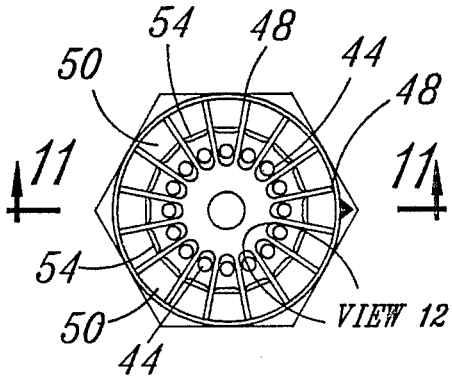
FIG. 10 is a cross sectional view of a slightly modified form of the sprinkler head of FIGS. 7, 8 and 9.
Figure 11:
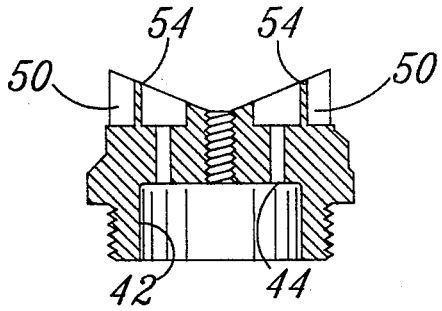
FIG. 11 is a cross sectional view taken along line 11—11 of FIG. 10.
Figure 12:
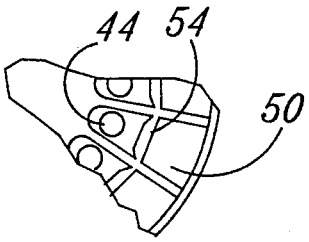
FIG. 12 is an enlarged view of segment 12 of FIG. 10.

FIGS. 10, 11 and 12 show a slightly modified form of the sprinkler head shown in FIGS. 7–9. FIG. 10 which is a cross-sectional view rather analogous to that of FIG. 2 shows a cross section through a device similar to that of FIG. 7 but with a modified form of plug blocking the passageways 44. In this embodiment, each of the outlet ports 50 includes a blocking web 54 which, rather than being located on the side of the water passageway 44, is in the outlet port 50 somewhat further downstream. This construction may become more apparent from consideration of the cross sectional view of Figure of 11 which taken along line 11—11 of FIG. 10. In this view it will be seen that the water flow to passages 44 is blocked by webs 54 which must be removed before water can flow through the outlet ports 50. The device of FIGS. 10 and 11, of course, contemplate a two-piece sprinkler head similar to that described above with respect to FIGS. 1–6. FIG. 12 is an enlarged view of a segment 12 of FIG. 10. In this view, again, the web 54 is shown effectively blocking the outlet port 50 and the outlet of water passageway 44.

In any of the embodiments described above, it is intended that the plugs in the injected molded parts or the webs may be punctured through use of a sharp object or tool supplied or even through use of a nail. By puncturing the desired sequence of holes the user can create any of a large number of pie-shaped water-coverage areas. He or she may skip sections of a circle if needed and, or course, control flow of the water by means of the adjustment screw to limit the distance of the water stream. The sprinkler head designs described above are all quite inexpensive and should be of injection molded plastic parts with the exception of the adjustment screws which may be may of stainless steel or of nylon. It will be recognized that these designs will enable a merchant or dealer to stock only one kind of sprinkler head rather than several since the sprinkler heads described may be field-programmed to cover all needs of the user.

A puncturable plug such as that shown in FIGS. 1–4, is of a design that can be punctured before installation and the groove around the plug is preferably formed to allow propagation of a crack in case the plug is not fully removed such that under pressure the plug will break cleanly and fall out. And while the two-piece design has been described as being fastened together by means of the water adjustment screw, once the parts are formed they could be bonded together, snapped together with suitable fastening means, or vibration welded.

I claim:

1. A sprinkler head for a sprinkling system including a source of water under pressure, coupling means connected to said sprinkler head including an orifice, pipes connecting said coupling means to said source, said sprinkler head comprising:

a first molded portion threadedly engaged with said coupling means including a substantial number of passageways each of which defines a water channel, is aligned with and is occluded by means of an individual integral barrier, a second molded portion having an outwardly tapered surface cooperating with a respective one of the said channels in said first molded portion to define a plurality of water directing outlet ports, and an adjusting screw threadedly engaged with said sprinkler head and including a valve member cooperating with said orifice to control flow, said molded barriers being capable of withstanding substantial water pressure without breaking but which are readily removable by a sharp instrument via said passageways to establish a desired sprinkling pattern for said sprinkler head.

2. A sprinkler head as claimed in claim 1 wherein said first molded portion and said second molded portion constitute first and second parts and said parts are secured together by means of said threaded adjusting screw, said integral barriers being plugs formed in said first part at the ends of said passageways.

3. A sprinkler head as claimed in claim 1 wherein said first molded portion and said second molded portion are formed of a single piece, said barriers being plugs formed in said passageways which are accessible for removal by the user when said sprinkler head is removed from said coupling means.

4. A sprinkler head as claimed in claim 3 wherein said barriers comprise normal water household pressure resistant webs molded into said channels which are accessible via said outlet ports to be selectively removed by the user when said sprinkler head is attached to said coupling means.

5. A sprinkler head as claimed in claim 1 wherein said first molded Zortion includes a plurality of fixed angular indicating index marks for referencing the location of the removed barriers which define the sprinkling pattern.

* * * * *